US007726384B2

(12) United States Patent
Hou et al.

(10) Patent No.: US 7,726,384 B2
(45) Date of Patent: Jun. 1, 2010

(54) HEAT PIPE

(75) Inventors: Chuen-Shu Hou, Tu-Cheng (TW); Tay-Jian Liu, Tu-Cheng (TW); Chao-Nien Tung, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 819 days.

(21) Appl. No.: 11/309,435

(22) Filed: Aug. 4, 2006

(65) Prior Publication Data

US 2007/0277963 A1 Dec. 6, 2007

(51) Int. Cl.
*F28D 15/04* (2006.01)

(52) U.S. Cl. ..... 165/104.26; 165/146

(58) Field of Classification Search ..... 165/104.26, 165/146
See application file for complete search history.

(56) References Cited

U.S. PATENT DOCUMENTS 3,018,087 A * 1/1962 Steele ..... 165/104.21
3,532,158 A * 10/1970 Hiebert ..... 165/104.26
3,613,778 A * 10/1971 Feldman, Jr. ..... 165/104.26
3,735,806 A * 5/1973 Kirkpatrick ..... 165/104.26
4,220,195 A 9/1980 Borgoyn et al.
6,003,591 A * 12/1999 Campbell ..... 165/104.26
2005/0077030 A1 4/2005 Wong

FOREIGN PATENT DOCUMENTS

JP 52024366 A * 2/1977 ..... 165/104.26
JP 55126788 A * 9/1980 ..... 165/104.26
JP 61093391 A * 5/1986

* cited by examiner

*Primary Examiner*—Leonard R Leo
(74) *Attorney, Agent, or Firm*—Jeffrey T. Knapp

(57) ABSTRACT

A heat pipe includes a hollow metal casing (100) and a honeycombed wick structure (200) arranged at an inner surface of the hollow metal casing. The wick structure includes a plurality of slices (210, 220) stacked together. Each of the slices has a plurality of pores therein and a plurality of protrusions (222) formed thereon along a longitudinal direction of the heat pipe to form a plurality of liquid channels (230) in the wick structure along the longitudinal direction of the heat pipe. Each liquid channel has alternate large and small sections (232, 231) along a length thereof.

14 Claims, 6 Drawing Sheets

HEAT PIPE

FIELD OF THE INVENTION

The present invention relates generally to a heat transfer apparatus, and more particularly to a heat pipe having a honeycombed wick structure.

DESCRIPTION OF RELATED ART

It is well known that a heat pipe is generally a vacuum-sealed pipe. A porous wick structure is provided on an inner face of the pipe, and the pipe is filled with at least a phase changeable working media employed to carry heat. Generally, according to positions from which heat is input or output, the heat pipe has three sections, an evaporating section, a condensing section and an adiabatic section between the evaporating section and the condensing section.

In use, the heat pipe transfers heat from one place to another place mainly by virtue of phase change of the working media taking place therein. Generally, the working media is liquid such as alcohol, water and the like. When the working media in the evaporating section of the heat pipe is heated up, it evaporates, and a pressure difference is thus produced between the evaporating section and the condensing section in the heat pipe. As a result vapor with high enthalpy flows to the condensing section and condenses there. Then the condensed liquid reflows to the evaporating section along the wick structure. This evaporating/condensing cycle continues in the heat pipe; consequently, heat can be continuously transferred from the evaporating section to the condensing section. Due to the continual phase change of the working media, the evaporating section is kept at or near the same temperature as the condensing section of the heat pipe.

However, during the phase change of the working media, the resultant vapor and the condensed liquid flows along two opposite directions, which reduces the speed of the condensed liquid in returning back to the evaporating section and therefore limits the heat transfer performance of the heat pipe. As a result, a heat pipe often suffers from drying-out at the evaporating section as the condensed liquid cannot be timely sent back to the evaporating section of the heat pipe.

In general, movement of the working fluid from the condensing section to the evaporating section depends on capillary action of the wick structure. The wick structure currently available for the heat pipe includes fine grooves integrally formed at the inner walls of the casing, screen mesh or bundles of fiber inserted into the casing and held against the inner walls thereof, or sintered powder combined to the inner walls through a sintering process.

However it is hard to obtain consistent characters during mass production of these wicks. Porosity of the wicks is difficult to control, which leads to varying thermal performances among heat pipes. Furthermore, the porosity of the wicks is limited to a small range, whereby a thermal resistance of the heat pipe is high. This also affects the heat dissipating performance of the heat pipe.

Therefore, it is desirable to provide a heat pipe having a honeycombed wick structure which can over the shortcomings of the related art.

SUMMARY OF THE INVENTION

The present invention relates to a heat pipe. The heat pipe includes a hollow metal casing and a honeycombed wick structure arranged at an inner surface of the hollow metal casing. The wick structure includes a plurality of slices stacked together. Each of the slices has a plurality of pores therein and a plurality of protrusions formed thereon along a longitudinal direction of the heat pipe to form a plurality liquid channels between the protrusions. Each of the liquid channels has alternate large and small sections along a length of the liquid channel. The liquid channels are communicated with micro-channels between two neighboring ones of the slices. The design of the liquid channels helps condensed liquid in the heat pipe to accelerate to return to an evaporating section from a condensing section of the heat pipe via the micro-channels.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present device can be better understood with reference to the following drawings. The components in the drawings are not necessarily drawn to scale, the emphasis instead being placed upon clearly illustrating the principles of the present device. Moreover, in the drawings, like reference numerals designate corresponding parts throughout the several views.

DETAILED DESCRIPTION OF THE INVENTION

Figure 1:
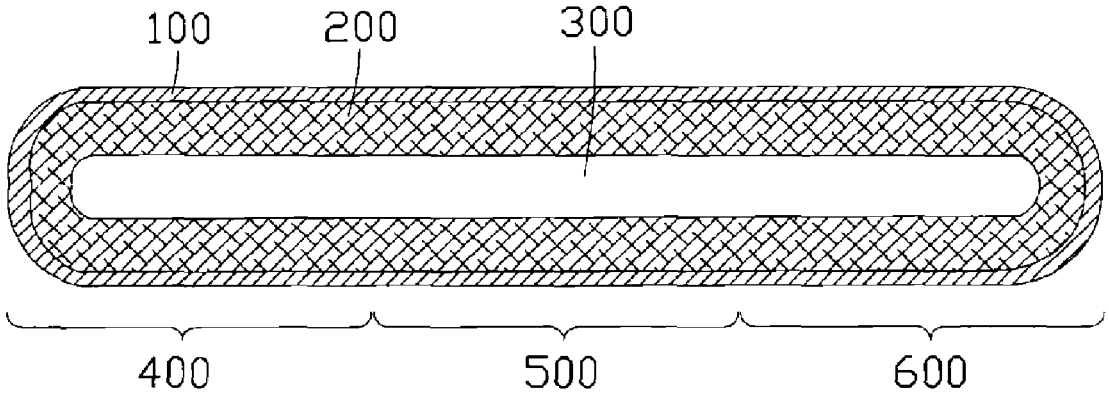
FIG. 1 is a longitudinally cross-sectional view of a heat pipe in accordance with a first embodiment of the present invention.

FIG. 1 illustrates a heat pipe in accordance with a first embodiment of the present invention. The heat pipe includes a sealed hollow metal casing 100 having an inner surface and a honeycombed wick structure 200 arranged at the inner surface of the casing 100. The inner surface of the casing 100 may be smooth or may define a plurality of micro-grooves therein.

The casing 100 includes an evaporating section 400 and a condensing section 600 at respective opposite ends thereof, and an adiabatic section 500 located between the evaporating section 40 and the condensing section 600. The casing 100 is typically made of highly thermally conductive materials such as copper or copper alloys. The honeycombed wick structure 200 is saturated with a working fluid (not shown), which acts as a heat carrier for carrying thermal energy from the evaporating section 400 toward the condensing section 600 when undergoing a phase transition from liquid state to vapor state. A vapor channel 300 is defined in the casing 100 along a lengthwise direction of the heat pipe.

Figure 2:
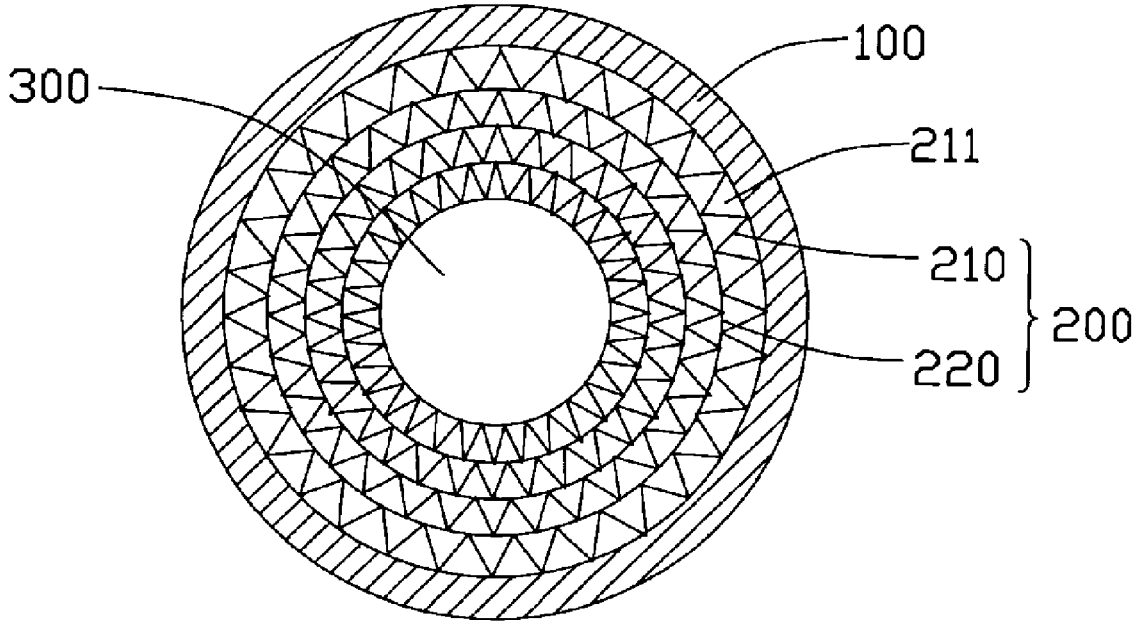
FIG. 2 is a transversely cross-sectional view of the heat pipe of FIG. 1, wherein the heat pipe forms a honeycombed wick structure arranged at an inner surface thereof, and the wick structure includes a waved slice and a planar slice.

Referring to FIG. 2, the honeycombed wick structure 200 comprises a first slice 210 attached on the inner surface of the casing 100 and a second slice 220 attached on the first slice 210. In this embodiment, the honeycombed wick structure 200 has a multiple layer structure consisting of a plurality of alternately stacked first slices 210 and second slices 220 along a radial direction of the heat pipe.

Each of the first slices 210 has a wave-shaped configuration when expanded, consisting of a plurality of triangular sections (not labeled) arranged along a circle. Each of the second slices 220 has a planar type configuration when expanded, and is wrapped into a circle sandwiched between two first slices 210. The first and second slices 210, 220 respectively define a plurality of pores (not shown) therein to form the honeycombed wick structure 200 with a plurality of micro-channels 211 therebetween for reflowing of the condensed liquid. The condensed liquid can flow from one micro-channel 211 to a neighboring micro-channel 211 via the pores. The first and second slices 210, 220 are made of metal sheets.

Figure 3:
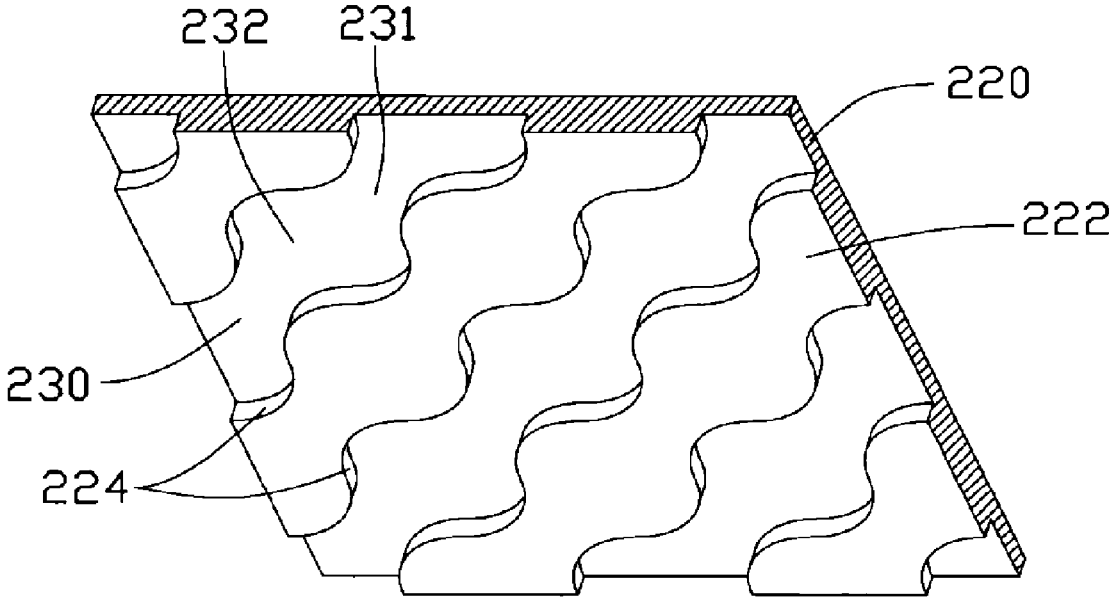
FIG. 3 is an enlarged, expanded view of a portion of the planar slice of FIG. 2.

Referring to FIG. 3, each of the second slices 220 forms a plurality of elongated protrusions 222 at a top surface thereof along the lengthwise direction of the heat pipe. Each of the protrusions 222 includes a pair of opposite and symmetrical lateral walls 224 extending along the lengthwise direction of the heat pipe. Each of the lateral walls 224 has a wave-shaped configuration. A plurality of liquid channels 230 are defined between two adjacent protrusions 222 for providing passage of the condensed liquid from the condensing section 600 to the evaporating section 400. The liquid channels 230 are communicated with the micro-channels 211. A cross section of each liquid channel 230 varies periodically with alternate small and large sections 231, 232. When the condensed liquid flows through the small sections 231 of the liquid channel 230, the velocity of the condensed liquid is increased. By the provision of the discrete small sections 231 of the liquid channel 230, the condensed liquid can be accelerated to flow through the liquid channel 230, whereby the condensed liquid can be speedily transported from the condensing section 600 to the evaporating section 400 via the micro-channels 211. Accordingly, the dry-out problem of the heat pipe can be solved; furthermore, the heat dissipation efficiency of the heat pipe can be promoted. The protrusions 222 can also be formed on the first slices 210.

Specifically, when the working fluid contained in the honeycombed wick structure 200 receives heat from a heat source in thermal connection with the evaporating section 400 of the heat pipe and turns into vapor, the vapor is quickly transferred toward the condensing section 600 via the vapor channel 300. At the condensing section 600, the vapor releases its heat and turns into liquid. Then, the condensed liquid is brought back, via the honeycombed wick structure 200, to the evaporating section 400 of the heat pipe where it is available again for evaporation.

Due to the honeycombed wick structure 200 being made of the first and second slices 210, 220 having the plurality of liquid channels 230 therein which have the plurality of narrow sections 231, the velocity of the liquid can be increased as flowing through the micro-channels 211 of the honeycombed wick structure 200. Moreover, porosity of the honeycombed wick structure 200 is relatively easy to control by regulating the configuration of the protrusions 222, and the number and size of the pores defined in the slices 210, 220; accordingly, heat transfer performance of the heat pipe can be further improved.

Figure 4:
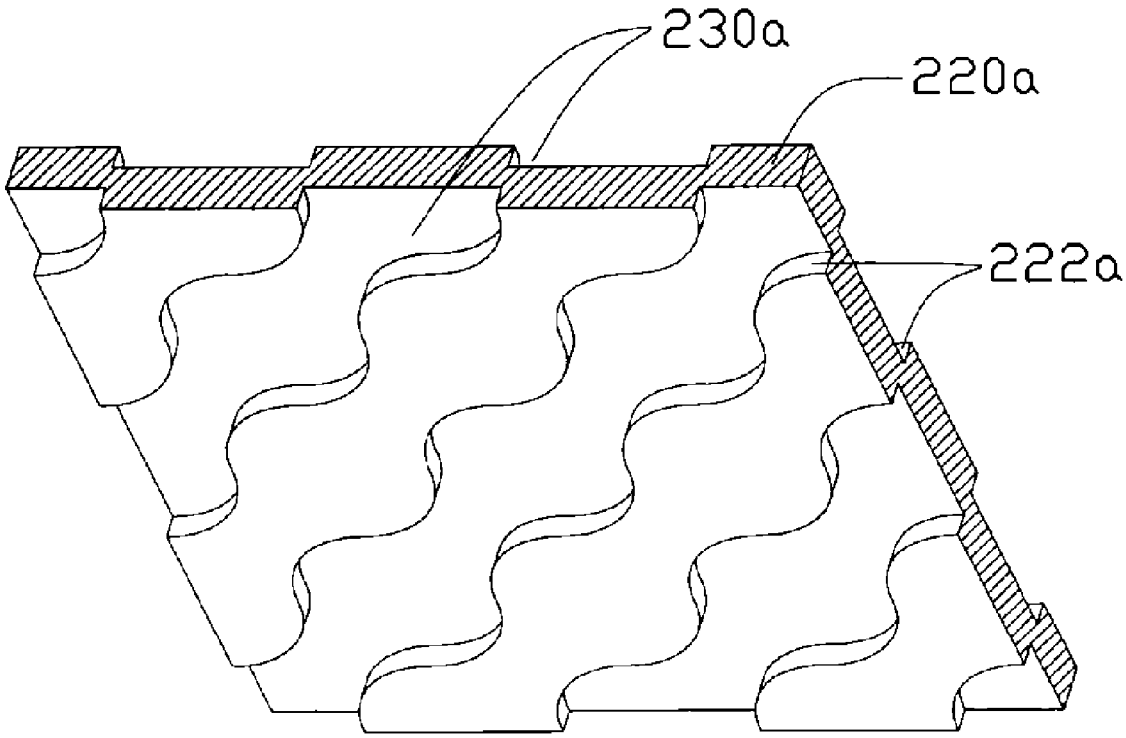
FIG. 4 is an enlarged, expanded view of a portion of a planar slice of a heat pipe in accordance with a second embodiment of the present invention.

FIG. 4 illustrates a second slice 220*a* of a honeycombed wick structure of a heat pipe in accordance with a second embodiment of the present invention. In this embodiment, protrusions 222*a* are formed on both top and bottom surfaces of the second slice 220*a* along a lengthwise direction of the heat pipe. The protrusions 222*a* have the same configuration as the first embodiment. The protrusions 222*a* alternate between the top and bottom surfaces of the second slice 220*a*. Thus the second slice 220*a* forms a plurality of liquid channel 230*a* each having a varied cross section periodically to improve the flowing speed of the condensed liquid through the micro-channels 211. In addition, the protrusions 222*a* can also be formed on both top and bottom surfaces of the first slice 210.

Figure 5:
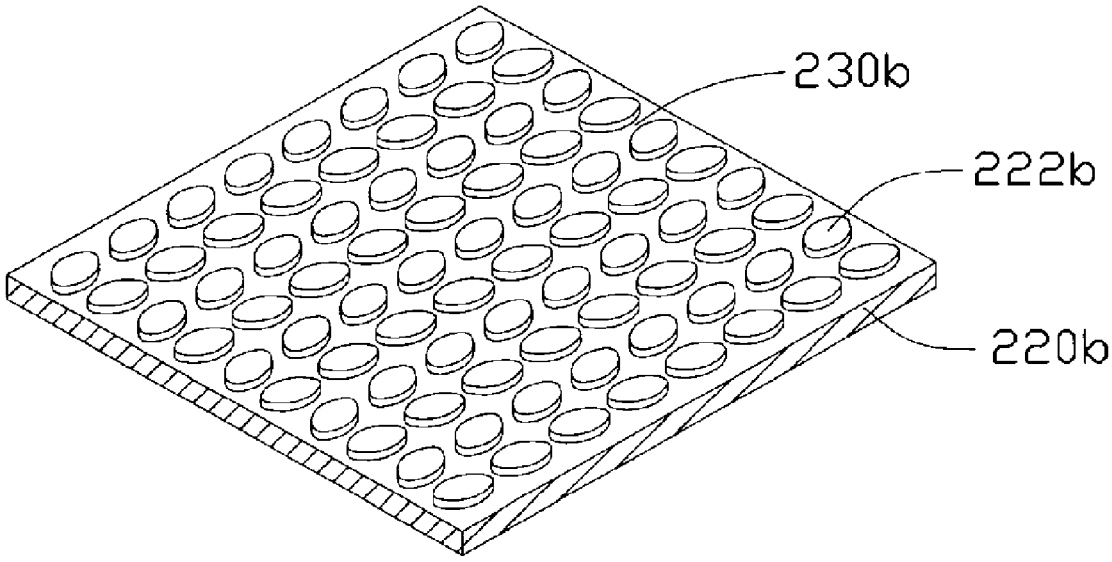
FIG. 5 is an enlarged, expanded view of a portion of a planar slice of a heat pipe in accordance with a third embodiment of the present invention.

FIG. 5 illustrates a second slice 220*b* of a honeycombed wick structure of a heat pipe in accordance with a third embodiment of the present invention. In this embodiment, the second slice 220*b* has a plurality of protrusions 222*b* formed thereon in a plurality of rows along a longitudinal direction of the heat pipe. Each of the protrusions 222*b* has an oval configuration with long and short axles. The protrusions 222*b* are slantwise arranged on the second slice 220*b* in such a manner that the long axes of two laterally neighboring protrusions 222*b* form an included angle therebetween. The protrusions 222*b* of two laterally adjacent columns have a mirror-symmetric pattern so that a liquid channel 230*b* with periodically reduced sections (not labeled) is defined between the adjacent protrusions 222*b* of the two laterally adjacent columns, thereby to accelerate the velocity of the liquid flowing through the liquid channels 230*b*, and accordingly the micro-channels 211.

Figure 6:
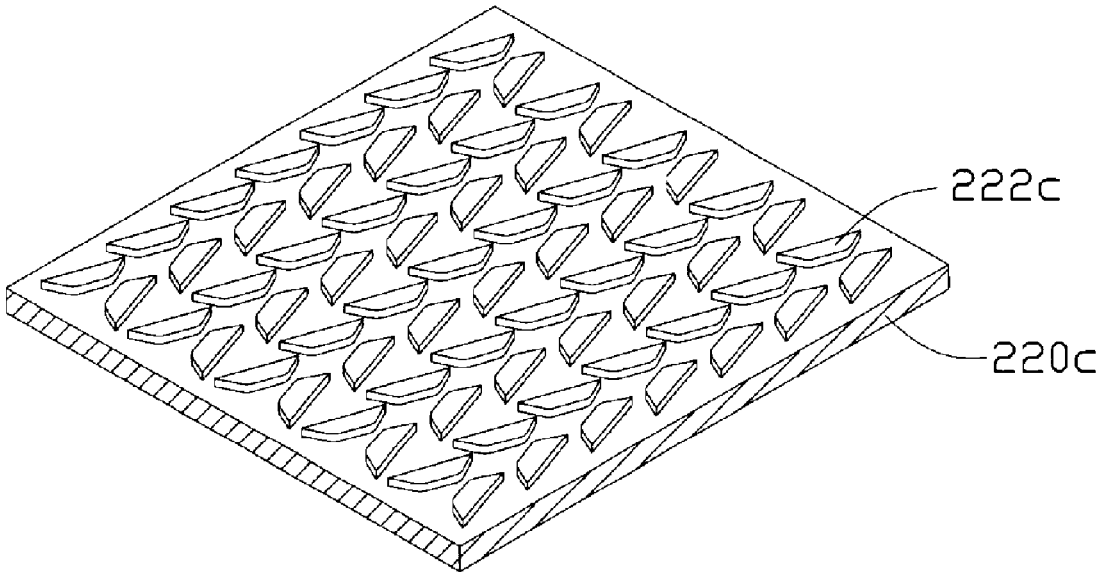
FIG. 6 is an enlarged, expanded view of a portion of a planar slice of a heat pipe in accordance with a fourth embodiment of the present invention.

FIG. 6 illustrates a second slice 220*c* of a honeycombed wick structure of a heat pipe in accordance with a fourth embodiment of the present invention. Protrusions 222*c* formed on the second slice 220*c* have characteristics similar to that of the protrusions 222*b* of the third embodiment. However, protrusions 222*c* each have a trapeziform shape. A liquid channel formed between two neighboring columns of the protrusions 222*c* has alternate large and small sections; thus, the condensed liquid can be accelerated to flow through the liquid channels, and accordingly, the micro-channels 211 of the honeycombed wick structure when flowing from the condensed section 600 to the evaporating section 400.

The protrusions of the previous embodiments of the invention can also be round in cross section shape, although other shapes such as triangular or crescent or the like may also be suitable, only if the protrusions allow the cross section of the liquid channel to vary along its extending direction.

It is known that porosity of the wick structure is an important parameter for the heat transfer capacity of the heat pipe. The honeycombed wick structure 200 of the invention is made of the plurality of first and second slices stacked together and having the plurality of protrusions thereon, whereby the porosity of the honeycombed wick structure 200 can be accurately controlled to improve the heat transfer performance of the heat pipe.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat pipe comprising:

a hollow metal casing;

a honeycombed wick structure arranged at an inner surface of the hollow metal casing, the wick structure including a plurality of slices stacked together in a radial direction of the heat pipe, each of the slices defining a plurality of pores therein and forming a plurality of protrusions thereon along a longitudinal direction of the heat pipe, thus forming a plurality of micro-channels in the honeycombed wick structure; and a working fluid inside the hollow metal casing;

wherein a plurality of liquid channels are defined between two adjacent protrusions for providing passage of the working fluid, and a cross section of each liquid channel varies periodically along a length of said each liquid channel.

2. The heat pipe of claim 1, wherein the protrusions are formed on both top and bottom surfaces of the slices, and the protrusions are alternate between the top and bottom surfaces of the slices.

3. The heat pipe of claim 1, wherein each of the protrusions comprises a pair of opposite and symmetrical lateral walls extending along the longitudinal direction of the heat pipe, and the lateral walls each have a wave-shaped configuration, thus the protrusions each having a cross section with a size varying periodically along a length of said each protrusion.

4. The heat pipe of claim 1, wherein the slices comprise at least one first slice and at least one second slice having a configuration different from that of the at least one first slice, and the at least one first slice and the at least one second slice are alternately stacked together.

5. The heat pipe of claim 4, wherein the at least one first slice has a waved configuration.

6. The heat pipe of claim 4, wherein the at least second slice has a planar type configuration.

7. The heat pipe of claim 1, wherein the slices are made of metal.

8. The heat pipe of claim 1, wherein the protrusions are formed on a top surface of the slices.

9. A heat pipe comprising:

a cylinder-shaped metal casing;

a working fluid inside the metal casing; and a wick structure attached on an inner wall of the metal casing for drawing the working fluid in a condensed state in the heat pipe from a condensing section to an evaporating section of the heat pipe, the wick structure comprising a plurality of alternate first and second slices stacked on each other along a radial direction of the heat pipe, wherein the first slices each have a waved configuration and the second slices each have a planar configuration, a plurality of micro-channels being formed between the first and second slices for flowing of the working fluid in a condensed state therethrough along a length direction of the heat pipe, at least one of top and bottom faces of at least one of the first and second slices having a plurality of protrusions thereon, a plurality of liquid channels being defined between the protrusions and extending along the length direction of the heat pipe, each of the liquid channels being formed with alternate large and small sections along a length thereof.

10. The heat pipe of claim 9, wherein the first and second slices are provided with a plurality of pores therein so that the micro-channels are communicated with each other via the pores.

11. The heat pipe of claim 9, wherein each of the protrusions is elongate with wave-like opposite lateral walls.

12. The heat pipe of claim 9, wherein each of the protrusions is oval in shape.

13. The heat pipe of claim 9, wherein each of the protrusions is trapeziform in shape.

14. A heat pipe comprising:

a hollow metal casing;

a honeycombed wick structure arranged at an inner surface of the hollow metal casing, the wick structure including a plurality of slices stacked together in a radial direction of the heat pipe, each of the slices defining a plurality of pores therein and forming a plurality of protrusions thereon along a longitudinal direction of the heat pipe, thus forming a plurality of micro-channels in the honeycombed wick structure; and a working fluid inside the hollow metal casing;

wherein the protrusions are formed on both top and bottom surfaces of the slice and the protrusions are alternate between top and bottom surfaces of the slices.

* * * * *